US005970556A

United States Patent [19]

Nemoto

[11] Patent Number: 5,970,556

[45] Date of Patent: Oct. 26, 1999

[54] DUST REMOVER

[75] Inventor: Hisashi Nemoto, Tokyo, Japan

[73] Assignee: Shinon Denkisangyo Kabushiki-Kaisha, Tokyo, Japan

[21] Appl. No.: 09/053,038

[22] Filed: Apr. 1, 1998

[30] Foreign Application Priority Data

Jun. 25, 1997 [JP] Japan ..... 9-184521

[51] Int. Cl.[6] ..... A47L 13/40

[52] U.S. Cl. ..... 15/1.51; 15/215; 15/217

[58] Field of Search ..... 15/1.51, 160, 161, 15/215, 216, 217; 361/212, 220

[56] References Cited

U.S. PATENT DOCUMENTS 3,665,543 5/1972 Nappi ..... 15/215

4,208,696 6/1980 Lindsay et al. ..... 361/212

4,363,071 12/1982 Rzepecki et al. ..... 361/220

*Primary Examiner*—Terrence R. Till

*Attorney, Agent, or Firm*—Lowe Hauptman Gopstein Gilman & Berner

[57] ABSTRACT

A dust remover for removing dirts or dusts comprises a cushioning material (1) made of a plurality of elastomeric filaments comprising a mixture of synthetic resinous material and a powdered electrical conductive material, said filaments are entangled each other to provide a plurality of through holes or voids extending vertically therethrough, a collector sheet (2) of electret laying under the cushioning material to provide a mat, a base (3) of insulating material for supporting the mat thereon, and a grounding cable (4) connected to the cushioning material.

6 Claims, 3 Drawing Sheets

DUST REMOVER

BACKGROUND OF THE INVENTION

1. Technical Field

The present invention relates to a dust remover suitable for removing dirt or dust from the underside of footgear such as shoes or slippers.

2. Description of the Prior Art

The foreign materials such as dirt or dust prevailing over the floor are adapted to be attracted electrostatically through the electric charge generated through the friction produced between the underside of footgear and the floor during walking.

Dirt or dust attracted or adhered on the underside of the footgear should be removed to keep the room clean. Specifically, as for the cleanroom, dust must be inhibited from getting thereinto, and for such purpose, a mat for removing dirt or dust or dust remover is to be provided at the entrance to the cleanroom.

In the case of the prior art mat, self-adherant material or adhesive is applied thereon, and the foreign materials on the underside of the footgear are bonded to the adhesive on the mat and removed thereby.

However, once the dirt or dust particles are bonded on a part of the mat, the self-adherant property of the part is reduced substantially, so that repeatedly utilizing the same part of the mat to remove the foreign material is essentially impracticable. In addition, washing the mat with water to remove the foreign material to restore the self-adherant property is very difficult. Ip other words, the prior mat may not be economically feasible.

Although some prior art dust removing mats may have a brush-shaped surface to remove the dirt or dust, the removed material tends to scatter in every directions while the mat is pressed by the footgear. In other words, a problem is present in dealing with the dirt or dust removed by such mat.

Accordingly the object of the present invention is to provide a dust remover which can eliminate the problem encountered in the prior art mat.

Another object of the present invention is to provide a dust remover of a highly enhanced long lasting dust removing property. The dust remover can be washed in water and utilized repeatedly.

SUMMARY OF THE INVENTION

These and other objects are achieved by a dust remover for removing dirt or dust in accordance with the present invention comprising a cushioning material made of a plurality of elastomeric filaments comprising a mixture of synthetic resinous material and a powdered electrical conductive material, said filaments are entangled each other to provide a plurality of through holes or voids extending vertically therethrough, a collector sheet of electret laying under the cushioning material to provide a mat, a base of insulating material for supporting the mat thereon, and a grounding cable connected to the cushioning material.

In the first embodiment of the dust remover of the present invention, an electrically conductive portion is provided with the base to contact with the cushioning material, and the grounding cable is connected to the electrically conductive portion.

In the second embodiment of the dust remover of the present invention, said electrically conductive portion is provided with an electrically conductive protrusion to contact with the cushioning material.

In the third embodiment of the dust remover of the present invention, the grounding cable is provided with a resistor.

In the fourth embodiment of the dust remover of the present invention, the cushioning material made of a plurality of elastomeric filaments comprising a mixture of vinyl chloride and a powdered carbon, said filaments are entangled each other to provide a plurality of through holes or voids extending vertically therethrough, a collector sheet of electret laying under the cushioning material, wherein said sheet comprising an electrostatically chargeable upper sheet and a lower sheet of synthetic resin bonded to the upper sheet.

In the fifth embodiment of the dust remover of the present invention, the upper sheet of said collector sheet is made of a non woven sheet of polypropylene fibrous material, and the lower sheet is made of non woven sheet of nylon fibrous material.

BRIEF DESCRIPTION OF THE DRAWINGS

Further feature of the present invention will become apparent to those skilled in the art to which the present invention relates from reading the following specification with reference to the accompanying drawings, in which.

DETAILED DESCRIPTION OF THE PRESENT INVENTION

Figure 1:
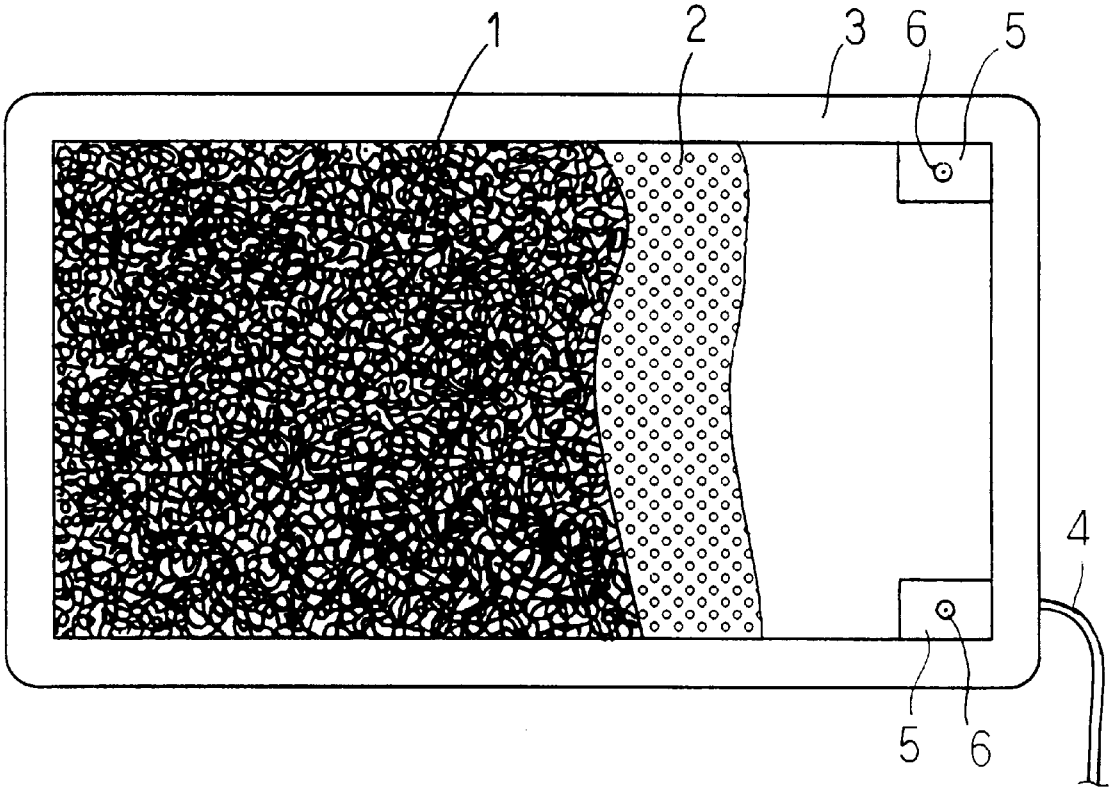
FIG. 1 is a partially broken plan view showing the structure of the dust remover of the present invention.
Figure 2:
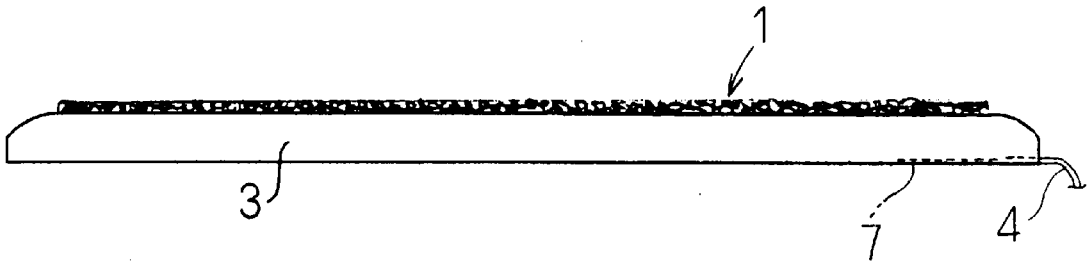
FIG. 2 is an elevational view of the dust remover shown in FIG. 1.
Figure 3:
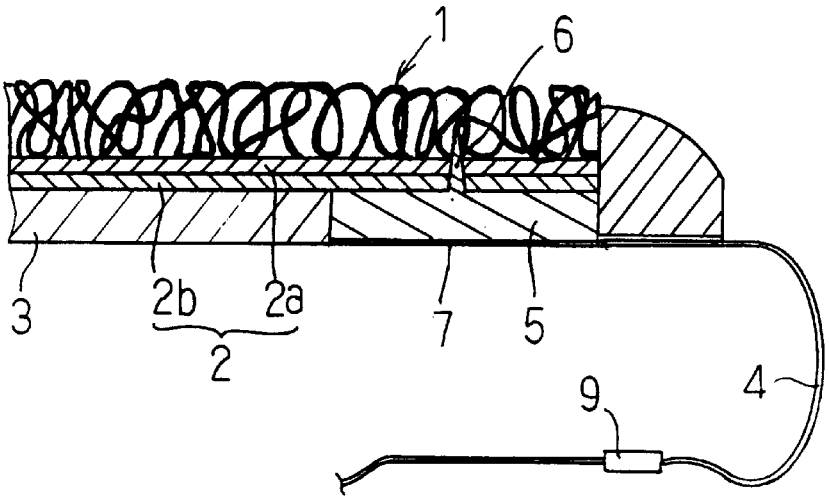
FIG. 3 is a partially broken vertical elevational view of the electrically conductive portion of the dust remover.
Figure 4:
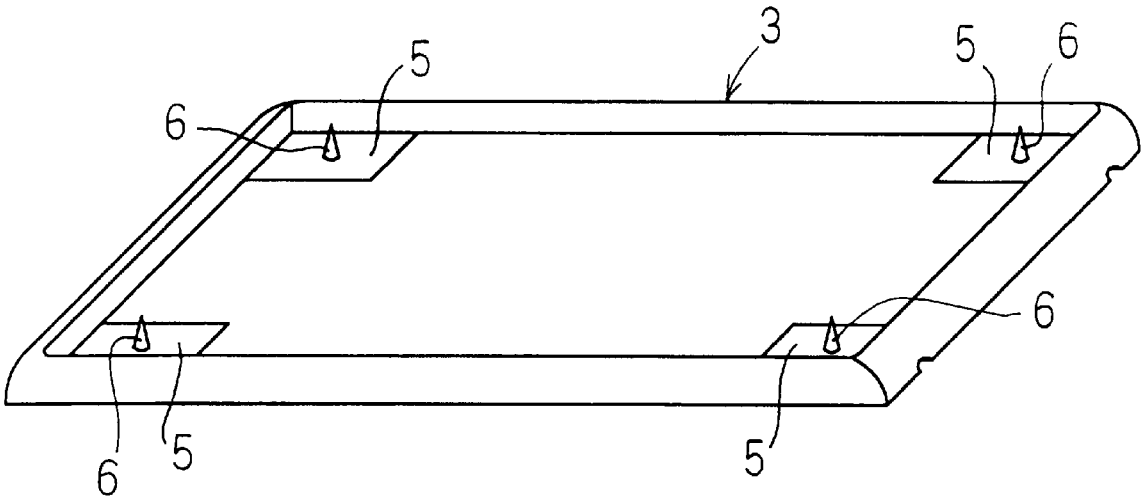
FIG. 4 is a persepective view of the base for supporting the mat.
Figure 5:
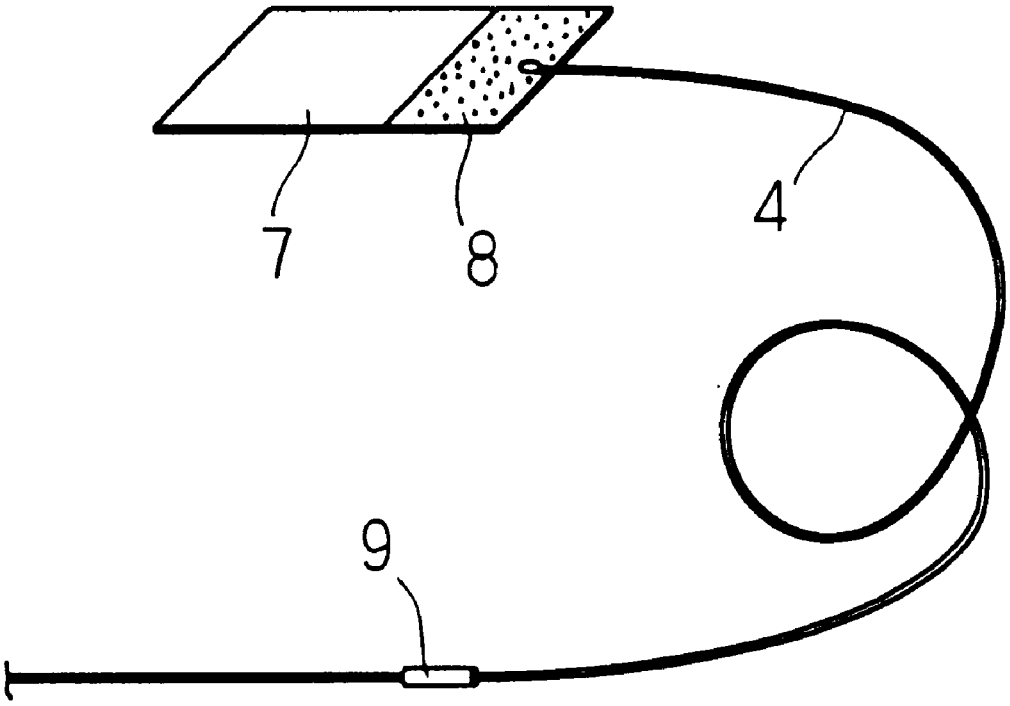
FIG. 5 is a persepective view of the grounding means.

A dust remover of the present invention will now be described with reference to the embodiment shown shematically in the attached drawings.

The dust remover of the present invention comprises a mat including a cushioning material 1 and a collector sheet 2 laying immediately below the material, and a base 3 for supporting the mat.

The cushioning material 1 is made of a plurality of curled or coiled filaments entangled randomly each other to provide a plurality of through holes or voids extending vertically from the top surface of the cushion 1 to the the bottom surface therethrough. The diameter of the filament is, for example, within the range from 0.8 mm to 1.0 mm. Each filament formed of the compound comprising a synthetic resinous material such as vynil chloride resin blended with a powdered electrical conductive material such as carbon. The electrical surface resistivity of the filament is preferably within the range frog $1\times10^5$ to $1\times10^9$ ($\Omega$).

The collector sheet 2 is made of 2-ply sheet material comprising upper and lower sheets 2*a* and 2*b* laying on the top of the other.

The upper sheet 2*a* is of electrostatically chargeable one made of a non woven sheet of polypropylene fibrous material. The diameter of the fibrous material is for example 2 μm. Specifically, the material is an electret electrically charged at about 0.6(nQ) formed under the presence of the voltage of 40,000(v). The lower sheet 2*b* is made of non woven material of synthetic resinous material such as nylon.

The upper and lower sheets 2*a* and 2*b* are bonded together by means of ultrasonic welding to form the collector sheet 2. Further, the collector sheet 2 is embossed to form the surface thereof to have a pattern of plurality of convexed and concaved shapes.

The base 3 is made of synthetic rubber, so that the frictional resistance and the flexibility of it is relatively high.

The dust remover of the present invention further includes a grounding cable 4 connected to the cushioning material 1. One of the means for connecting the grounding cable 4 to the cushioning material 1 will now be described merely as an example thereof.

In a portion or portions of the base, such as a corner or corners of the base are provided with an electrically conductive portion 5.

The electrically conductive portion may be made of such a material as a synthetic rubber blended with carbon black, and formed and vulcanized integrally with the base 3.

The electrically conductive portion 5 is provided with an electrically conductive protrusion 6 formed integrally therewith to protrude from the upper surface of the portion 5. The protrusion 6 is adapted to pierce the collector sheet 2 to contact with the cushioning material 1, while the mat is to be placed on the base to complete the assembly.

A grounding plate 7 connected to one end of the cable 4 is adapted to be adhered to the lower surface of the electrically conductive portion 5. Concretely, a pressure sensitive adhesive double coated tape 8 is adhered on a portion of the upper surface of the grounding plate 7 and peel off the release paper, and then the grounding plate 7 is connected adhesively to the bottom surface of the electrically conductive portion 5.

Thus, the electrostatic charge prevailing over the cushioning material is leaked to the ground.

When washing of the base is to be made,the grounding plate 7 is removed from the base. Once washing is completed, a new adhesive double coated tape will be attached to the plate 7, and then the plate is connected to the portion 5.

The cable 4 is also provided with a resistor 9.

The resistor is adapted to protect the cushioning material 1 from excessively large current, when such current is produced through the grounding wire of the building to which the grounding cable 4 is to be connected. Thus the one standing on the cushion will be protected from electric shock. The preferred value of the electrical resistance of the resistor 9 may be within the range from $1\times10^5$ to $1\times10^9$ (Ω), preferrably $1\times10^6$ (Ω).

Of course the grounding plate 7 can be disposed between the cushioning material 1 and the collector sheet 2 to directly contact the grounding plate 7 with the cushioning material 1. In such a case, it is necessary to provide the base neither with the electrically conductive portion 5 nor the electrically conductive protrusion 6.

In the aforementioned dust remover of the present invention, the cushioning material will be deformed substantially in the concave shape while stepping in the remover, so that relatively larger particles of dust on the sole of the footgear may be removed phisically through the friction with the cushioning material.

On the other hand, relatively smaller perticles attracted electrostatically on the surface of the sole will also depart therefrom at the contact with the dust remover. This is because the static electricity of the charged particle is attenuated quickly and substantially through the surface of the filament of reduced surface resistance, electrically conductive portion 5 of the base, and grounding cable, and delivered to the ground.

Thus departed particles are attracted electrostatically by means of collector sheet 2 of electret laying under the cushioning material 1 through the vertically extending plurality of through holes or voids of the cushioning material.

The dust remover of the present invention will present the following advantages.

(a) The scattering of the smaller particles attracted on the collector sheet under the effect of air pressure caused by the stepping in of the footgear is avoided;

(b) In contrast with the prior art mat, in which the self-adherant property of the once stepped part is reduced substantially, the dust remover of the present invention can be used for relatively long term. This is because the present dust remover will preserve its capability as a dust collector, even if stepped repeatedly;

(c) The collected dust particles can be disposed of as a whole with the collector sheet. The collector sheet may either be interchanged with new one, or be restored by washing with water and reused;

(d) The cushioning material can be cleaned by washing by water and reused repeatedly;

(e) The base does not slipped on the floor due to its high frictional resistance;

(f) The static electricity charged on the sole of the footgear can substantially be attenuated through the contact with the grounding cable connected to the cushioning material, so that dust can surely be removed.

(g) The resistor assembled with the grounding cable prevents the excessive current from flowing through the cushioning material, while such current is produced through the grounding wire of the building to which the grounding cable is to be connected. In other words, the safeguard against the excessive current may be provided.

The dust remover of the present invention providing the above mentioned functions and effects will, in the case that the dust remover is positioned at the entrance to the cleanroom, serves to inhibit the entering of the particle of dust or so to keep clealiness of the room.

While particular embodiments of the present invention have been illustrated and described, it should be obvious to those skilled in the art that various changes and modifications can be made without departing from the spirit and scope of the invention.

What is claimed is:

1. A dust remover for removing dust and dirt comprising;

a cushioning material made of a plurality of elastomeric filaments comprising a mixture of synthetic resinous material and a powdered electrical conductive material, said filaments are entangled with each other to provide a plurality of through holes or voids extending vertically therethrough, a collector sheet of electret laying under the cushioning material to provide a mat, a base of insulating material for supporting the mat thereon, and a grounding cable connected to the cushioning material.

2. The dust remover according to claim 1 wherein an electrically conductive portion is provided with the base to contact with the cushioning material, and the grounding cable is connected to the electrically conductive portion.

3. The dust remover according to claim 2 wherein said electrically conductive portion is provided with an electrically conductive protrusion to contact with the cushioning material.

4. The dust remover according to claim 1 wherein the grounding cable is provided with a resistor.

5. The dust remover according to claim 1 wherein the cushioning material made of a plurality of elastomeric filaments comprising a mixture of vinyl chloride and a powdered carbon, said filaments are entangled with each other to provide a plurality of through holes or voids extending vertically therethrough, a collector sheet of electret laying under the cushioning material, wherein said sheet comprising an electrostatically chargeable upper sheet and a lower sheet of synthetic resin bonded to the upper sheet.

6. The dust remover according to claim 5 wherein the upper sheet of said collector sheet is made of a non woven sheet of polypropylene fibrous material, and the lower sheet is made of non woven sheet of nylon fibrous material.

* * * * *